US006000143A

United States Patent [19]

Oechsle

[11] Patent Number: 6,000,143

[45] Date of Patent: Dec. 14, 1999

[54] MACHINE TO MANUFACTURE A MATERIAL A SHEET, IN PARTICULAR PAPER OR CARDBOARD SHEET

[75] Inventor: Markus Oechsle, Bartholomae, Germany

[73] Assignee: Voith Sulzer Papiermaschinen GmbH, Heidenheim, Germany

[21] Appl. No.: 08/956,589

[22] Filed: Oct. 23, 1997

[30] Foreign Application Priority Data

Oct. 31, 1996 [DE] Germany ..... 196 44 018

[51] Int. Cl.[6] ..... F26B 11/06; D21F 5/00

[52] U.S. Cl. ..... 34/117; 34/118; 34/121

[58] Field of Search ..... 34/447, 454, 117, 34/118, 121, 126

[56] References Cited

U.S. PATENT DOCUMENTS

| | | | |
|---|---|---|---|
| 4,495,711 | 1/1985 | Justus . | |
| 4,495,712 | 1/1985 | Justus . | |
| 4,882,855 | 11/1989 | Loser et al. . | |
| 5,467,534 | 11/1995 | Salter et al. | 34/121 X |
| 5,505,006 | 4/1996 | Wulz et al. | 34/121 X |
| 5,557,860 | 9/1996 | Kotitschke et al. | 34/117 X |
| 5,588,224 | 12/1996 | Gianforte et al. . | |
| 5,632,101 | 5/1997 | Oeschle | 34/117 X |
| 5,638,611 | 6/1997 | Oeschle | 34/447 |
| 5,743,024 | 4/1998 | Oeschle | 34/117 X |

FOREIGN PATENT DOCUMENTS

| | | |
|---|---|---|
| 1395938 | 3/1965 | France . |
| 3322996 | 1/1984 | Germany . |

OTHER PUBLICATIONS

Copy of a German Search Report, dated Jun. 9, 1997.

*Primary Examiner*—Henry Bennett
*Assistant Examiner*—Steve Gravini
*Attorney, Agent, or Firm*—Greenblum & Bernstein, P.L.C.

[57] ABSTRACT

A machine is proposed for the production of a material sheet, in particular a paper or cardboard sheet, with a dryer section which exhibits at least one double-row dryer group consisting of two rows of heated dryer cylinders, each of which has been assigned a transport belt circulating in a meandering fashion around the dryer cylinders of one row and the deflection rolls assigned to the dryer cylinders, thereby pressing the material sheet against the surface of the dryer cylinders, and having a drive mechanism consisting of at least one motor assigned to each row of dryer cylinders of a double-row dryer group, which causes a rotation of the dryer cylinders and deflection rolls as well as a circulation of the transport belts of the dryer section, in which the drive mechanism is designed such that the rotational speed of the two rows of dryer cylinders within the double-row dryer group can be regulated independently of one another.

14 Claims, 1 Drawing Sheet

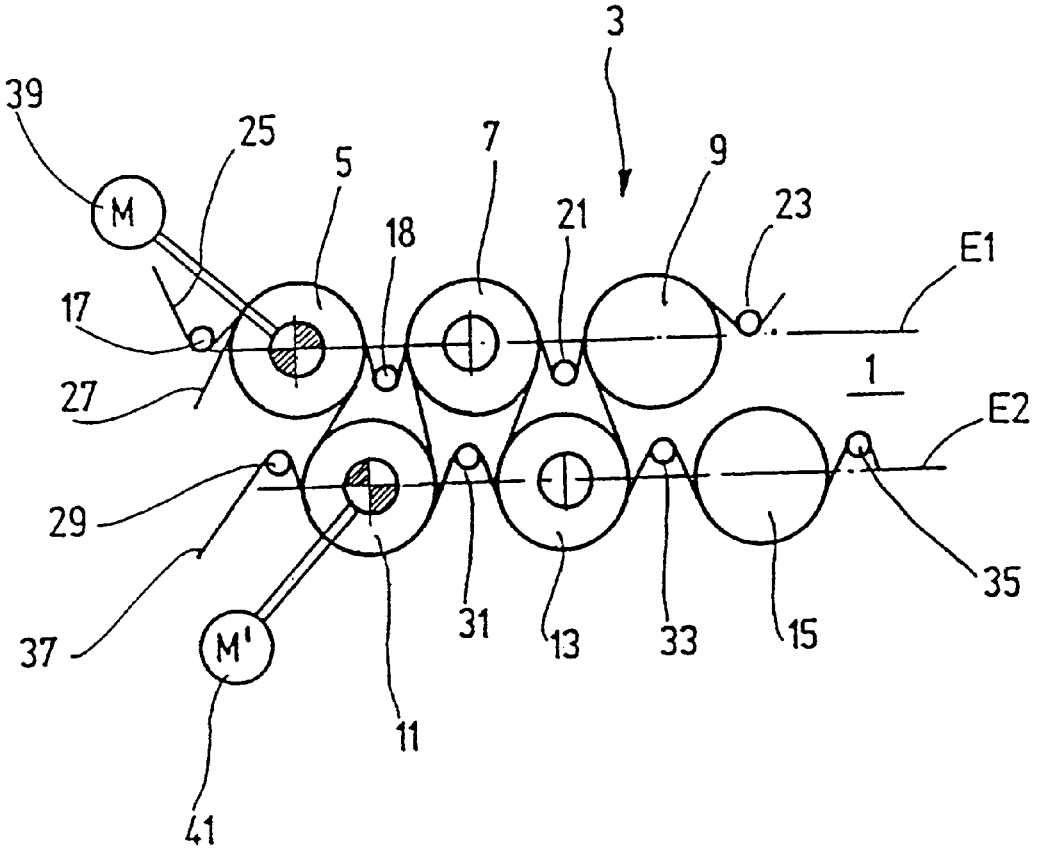
Fig.

MACHINE TO MANUFACTURE A MATERIAL A SHEET, IN PARTICULAR PAPER OR CARDBOARD SHEET

CROSS-REFERENCE OF RELATED APPLICATIONS

The present application claims priority under 35 U.S.C. § 119 of German Patent Application No. 196 44 018.1, filed Oct. 31, 1996.

BACKGROUND OF THE INVENTION

1. Field of the Invention

The present invention relates to a machine for manufacturing a material sheet, in particular a paper or cardboard sheet, with a dryer section including at least one double-row dryer group having two rows of heated dryer cylinders. Each of the two rows of heated cylinders has been assigned a transport belt circulating in a meandering fashion around the dryer cylinders of each row and around the deflection rolls assigned to the respective row of dryer cylinders. The transport belt is adapted to press the material sheet against the surfaces of the dryer cylinders. The machine also includes a drive mechanism, comprising at least one motor associated with each row of dryer cylinders, to rotate the dryer cylinders and deflection rolls and to circulate the transport belts of the dryer section. The drive mechanism is adapted to independently regulate the rotational speeds of the rows of dryer cylinders.

The present invention further relates to a method for manufacturing a material sheet in a dryer section with at least one double-row dryer group having two rows of heated dryer cylinders, each also having a transport belt circulating in a meandering fashion around the dryer cylinders and deflection rolls assigned to the dryer cylinders thereby pressing the material sheet against the surfaces of the dryer cylinders, and a drive mechanism which includes at least one motor assigned to each row of dryer cylinders of the double-row dryer group. The method includes rotating the dryer cylinders and deflection rolls, whereby the transport belts are circulated through the dryer section. The rotational speed of the cylinders in the two rows is driven independently.

2. Discussion of Background Information

Machines of the type generally mentioned herein are discussed, e.g., in DE 33 22 996 C2. This document discloses a dryer section with at least one double-row dryer group. Double-row dryer groups include two rows of heated dryer cylinders, each of which is assigned a felt, also known as a dryer screen, which together with the material sheet circulates in a meandering manner around the dryer cylinders of one row and the deflection rolls assigned to the dryer cylinders, thereby pressing the material sheet against the surface of the dryer cylinders. The material sheet circulates alternatingly around the dryer cylinders of both rows of the double-row dryer group, so that the upper and lower sides of the material sheet alternately come in contact with the dryer cylinders. The known machine exhibits a drive mechanism which sets the dryer cylinders in rotation and causes the felts of the dryer section to circulate.

If a sheet tear occurs, the material sheet is threaded into the machine in the following manner: first, the material sheet is guided only up to the end of a so-called press section or to the beginning of the dryer section and, during a start-up phase, arrives in an area underneath the machine in a discharge-release system. The material sheet runs at nearly full operational speed. Next, a relatively narrow strip, known as a ribbon or threading-strip, is removed from the edge of the sheet. This is then guided through the dryer section, which can consist of single- and double-row dryer groups. It is known that the insertion of the threading strip is problematic. Among other things, ropes have been used to assist in this which, however, do not ensure the required safety in the threading procedure and in addition present a safety hazard to the operating personnel.

It is also known that threading strips can be guided through the machine without the aid of ropes. Scrapers and air jet nozzles, or combined scrapers and air jet nozzles are, for example, used thereby to remove the threading strips from the individual cylinders and guide them through the machine.

It has been determined that errors occur in a great number of cases during such ropeless insertions, so that the threading procedure must be repeated.

SUMMARY OF THE INVENTION

It is thus the task of the present invention to provide a machine and a procedure to manufacture a material web which does not suffer from the above-noted disadvantages of the prior art.

To solve the task a machine is proposed which includes a dryer section having at least one double-row dryer group which has two rows of heated dryer cylinders, each of which has been assigned a transport belt circulating in a meandering fashion around the dryer cylinders of one row and the deflection rolls assigned to the dryer cylinders, and having a drive mechanism which causes a rotation of the dryer cylinders and deflection rolls as well as a circulation of the transport belts of the dryer section, having at least one motor assigned to each row of dryer cylinders of the double-row dryer group. The machine includes a drive mechanism which is constructed such that the rotational speed of both rows of dryer cylinders within the double-row dryer group can be regulated independently of one another. It is thereby possible to affect the transfer of the ribbon or threading strip such that the threading procedure can be performed very safely.

One example of the machine has a drive mechanism which is constructed such that during the transfer of the threading strip within the double-row dryer group, the row of dryer cylinders which transfers the threading strip rotates faster, at least temporarily. It has been determined that a safe transfer of the threading strip can thereby be ensured.

Another embodiment of the invention exhibits a rotational speed of the first row of dryer cylinders, which receive the threading strip, which exceeds the rotational speed of the second row of cylinders, which receive the threading strip from the first row, by approximately 1%. With such a slight difference in the number of revolutions, it is possible to maintain the different rotational speeds during operation, even when the threading strip has been safely guided through the dryer section and the dryer section has been impacted by the full width of the material sheet.

To solve the task, a method to manufacture a material sheet is also provided which includes a dryer section which exhibits at least one double-row dryer group having two rows of heated dryer cylinders each of which has been assigned a transport belt circulating in a meandering fashion around the dryer cylinders of one row and the deflection rolls assigned to the dryer cylinders, thereby pressing the material sheet against the surface of the dryer cylinders, and having a drive mechanism with at least one motor assigned to each row of dryer cylinders of a double-row group, which causes rotation of the dryer cylinders and deflection rolls as well as a circulation of the transport belts of the dryer section. A unique advantage is that both rows of dryer cylinders of a double-row dryer group may be driven at rotational speeds which are independent of one another. A safe reception of the threading strip can thereby be ensured.

The present invention provides a machine to manufacture a material sheet. The machine includes a dryer section with at least one double-row dryer group having first and second rows of heated dryer cylinders, deflection rolls associated with the dryer cylinders, and a transport belt associated with each of the first and second rows of dryer cylinders that circulates in a meandering fashion around the dryer cylinders and the associated deflection rolls. The transport belt is adapted to press the material sheet against surfaces of the dryer cylinders. The machine includes a drive mechanism which includes at least one motor associated with each of the first and second rows, which rotates the dryer cylinders and associated deflection rolls, and circulates the transport belts of the dryer section. The drive mechanism is adapted to independently regulate a rotational speed of the first and second rows.

In one embodiment, the drive mechanism at least temporarily drives the first row of dryer cylinders, which receives the material sheet at the beginning of the double-row dryer group, at a rotational speed greater than the rotational speed of the second row of dryer cylinders, which receives the material sheet from the first row of dryer cylinders. Preferably, the rotational speed of the first row of dryer cylinders is approximately 0.3% to approximately 1.8% greater than the rotational speed of the second row of dryer cylinders. More preferably, the rotational speed of the first row of dryer cylinders is approximately 0.6% to approximately 1.4% greater than the rotational speed of the second row of dryer cylinders; and the rotational speed of the first row of dryer cylinders is most preferably approximately 1% greater than the rotational speed of the second row of dryer cylinders.

In an alternative embodiment, the rotational speed of the first row of dryer cylinders is greater than that of the second row only during the transfer of a threading strip.

In another embodiment of the invention, at least one dryer cylinder of each row is assigned a motor.

In accordance with certain embodiments of the invention, the material sheet may be paper, and may also be cardboard.

The present invention also provides a method to manufacture a material sheet in a dryer section having two rows of heated dryer cylinders and a transport belt circulating in a meandering fashion around the dryer cylinders and deflection rolls assigned to the dryer cylinders of each of the two rows. The belt presses the material sheet against the surfaces of the dryer cylinders. The method includes associating at least one motor with each row of dryer cylinders. The method also includes rotating the dryer cylinders and deflection rolls, whereby the transport belts are circulated through the dryer section. The rotational speed of the two rows is independently driven.

One embodiment of a method of the present invention includes at least temporarily rotating a first row of dryer cylinders which receives the material sheet, at a rotational speed greater than the rotational speed of a second row of dryer cylinders which receives the material sheet from the first row of dryer cylinders. A preferable embodiment includes rotating the first row of dryer cylinders at a rotational speed approximately 0.3% to approximately 1.8% greater than the rotational speed of the second row of dryer cylinders. More preferably, the method includes rotating the first row of dryer cylinders at a rotational speed approximately 0.6% to approximately 1.4% greater than the rotational speed of the second row of dryer cylinders. The first row of dryer cylinders is most preferably rotating at a rotational speed approximately 1% greater than the rotational speed of the second row of dryer cylinders.

Another embodiment of a method of the present invention includes driving at least one dryer cylinder of each row by a motor.

The present invention also provides an apparatus for manufacturing a material sheet which has a double-row dryer group with first and second rows of dryer cylinders, and at least one transport belt adapted to guide a material sheet. Each of the first and second rows have dryer cylinders and deflection rolls arranged to guide the transport belt in a meandering path around the dryer cylinders. The transport belt is adapted to press the material sheet against the dryer cylinders. The apparatus includes a drive mechanism driving the dryer cylinders which includes at least one motor assigned to each row of dryer cylinders. The at least one motor is adapted to be independently regulated by the drive mechanism.

One embodiment of the present invention is an apparatus wherein the rotational speed of at least one cylinder of the first row of dryer cylinders is at least temporarily higher than the rotational speed of at least one cylinder of the second row of dryer cylinders. In a preferred embodiment, the rotational speed of at least one cylinder of the first row of dryer cylinders is between approximately 0.3% and 1.8% higher than the rotational speed of at least one cylinder of the second row of dryer cylinders. More preferably, the rotational speed of at least one cylinder of the first row of dryer cylinders is between approximately 0.6% and 1.4% higher than the rotational speed of at least one cylinder of the second row of dryer cylinders. The rotational speed of at least one cylinder of the first row of dryer cylinders is most preferably approximately 1% higher than the rotational speed of at least one cylinder of the second row of dryer cylinders.

In one embodiment of an apparatus of the present invention, the rotational speed of at least one cylinder of the first row of dryer cylinders is higher than the rotational speed of at least one cylinder of the second row of dryer cylinders only during the transfer of a threading strip.

The present invention also provides an embodiment in which at least one cylinder of each row dryer cylinders is directly driven by a motor.

BRIEF DESCRIPTION OF THE DRAWINGS

The present invention is further described in the detailed description which follows, in reference to the noted drawing by way of non-limiting examples of embodiments of the present invention, and wherein:

The FIGURE shows a part of a machine to manufacture a material sheet, according to one embodiment of the present invention, in highly schematic lateral view.

DETAILED DESCRIPTION OF THE INVENTION

The particulars shown herein are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing making apparent to those skilled in the art how the several forms of the invention may be embodied in practice.

The schematic diagram shows a section of a double-row dryer group 1 which is part of a dryer section of a paper-manufacturing machine 3.

Dryer group 1 exhibits a first row of dryer cylinders 5, 7 and 9, whose centers lie on an imagined plane E1. The dryer cylinders 11, 13 and 15 of a second row of dryer cylinders, whose centers lie on an imagined plane E2, are each arranged offset to the dryer cylinders 5, 7 and 9. The two planes lie at a distance from one another and are here parallel to each other. It is, however, conceivable to design another arrangement of the dryer cylinders.

The first row of dryer cylinders 5, 7 and 9 are assigned deflection rolls 17, 18, 21 and 23 which serve to deflect a transport belt 25, also known as a dryer felt or screen, which is guided around the dryer cylinders 5, 7 and 9 together with the material sheet 27.

In the same manner, the lower row of dryer cylinders 11, 13 and 15 is assigned a number of deflection rolls 29, 31, 33 and 35, around which a transport belt 37, also known as a dryer felt or screen, is guided in a meandering manner around the dryer cylinders and deflection rolls.

The material sheet 27 is guided such that it lies against the surface of the dryer cylinders and is pressed against the surface by the transport belt 25 or 37. The material sheet runs through the dryer cylinders of the upper and lower rows alternating its sides in such a way that the lower and upper sides of the material sheet are dried alternately.

In the embodiment example displayed here, the material sheet 27 is deposited onto the first dryer cylinder 5 of the upper row of dryer cylinders and from the first dryer cylinder 5 of the upper row arrives at the first dryer cylinder 11 of the lower row of the double-row dryer group 1.

The dryer group is equipped with a drive mechanism which here comprises a motor 39 assigned to the first dryer cylinder 5 of the upper row and a motor 41 assigned to the first dryer cylinder 11 of the lower row. It is possible to assign individual motors to several dryer cylinders of a row. It is, however, also conceivable that the turning moment introduced in a dryer cylinder is transferred to the other dryer cylinders of a row via the transport belt 25 or 37. Finally, it is also possible to construct the drive mechanism such that the transport belts 25 and 37 are driven by separate motors and set the dryer cylinders in rotation.

The essential feature is that the drive mechanism of dryer group 1 is constructed such that the rotational speed of the dryer cylinders 5, 7 and 9 of the first row of the dryer group 1 can be regulated independently of the rotational speed of the dryer cylinders 11, 13 and 15 of the second row of dryer group 1. It is thereby possible to coordinate the rotational speeds of the two rows of dryer cylinders to each other in such a way that a ropeless transfer of a so-called ribbon or threading strip can be performed without difficulty.

It has been determined that a difference between the rotational speeds of the two rows of dryer cylinders is particularly advantageous. A particularly disturbance-free transfer of the threading strip is ensured when the rotational speed of the dryer cylinder onto which the material sheet 27 is deposited at the beginning of dryer group 1, and which transfers the material sheet to the second row of dryer cylinders, is greater. In the embodiment example displayed in the FIGURE, the dryer cylinders 5, 7 and 9 of the upper row are turning faster than the dryer cylinders 11, 13 and 15 of the lower row of dryer group 1.

A difference in rotational speed from about 0.3% to about 1.8% is preferred. More effective is a difference in rotational speed from about 0.6% to about 1.4%. Particularly preferred is a differential rotational speed of about 1%.

When a difference in rotational speed of both rows of dryer cylinders is about 1%, a continuous operation of the dryer group 1 is possible even when the threading strip is guided successfully through the dryer group or dryer section and the material sheet runs through the dryer cylinders at its full width. However, it is also preferable to developments a variable rotational speed for both rows of dryer cylinders and to maintain the difference in rotational speeds only temporarily, namely only during the insertion of a threading strip.

All of the above results in a method to manufacture a material sheet, in particular a paper or cardboard sheet, in which both rows of dryer cylinders 5, 7 and 9 or 11, 13 and 15 of dryer group 1 are driven independently, preferably at different rotational speeds. It has been proven to be particularly effective to assign a motor to at least one dryer cylinder in each row and to thereby ensure that the row of dryer cylinders which receives the material sheet at the beginning of the dryer group and which transfers this to the second row of dryer cylinders exhibits a higher rotational speed. The second row is assigned its own motor.

The difference in rotational speed which prevails at least temporarily, in particular during the threading procedure, has been explained above in detail. It was thereby shown that a 1% higher rotational speed of the dryer cylinder which receives the material sheet is especially advantageous. In this manner the threading strip received by dryer group 1 is transferred at a somewhat higher speed from the first dryer cylinder 5 of the upper row of dryer group 1 to the first dryer cylinder 11 of the lower row of dryer cylinders. The threading strip is thus deposited onto the receiving dryer cylinder at a somewhat higher speed than that at which the receiving dryer cylinder rotates.

The different rotational speeds can be realized particularly easily when at least one dryer cylinder of a row each is driven by its own motor.

Yet another essential feature is that a mechanical coupling of the two motors 39 and 41 is not required, so that the rotational speeds can be especially easily regulated. At the same time the noise formation is particularly low when there is no mechanical coupling.

After all this it becomes evident that the machine or the method to manufacture a material sheet can be widely used and is not limited to the manufacture of a paper or cardboard sheet. Of significance is the fact that the machine and the method are particularly suited to inserting a threading strip with a reduced width through the machine, whereby after having been inserted, the threading strip will be spread out across the full width of what will later become the material sheet. The manufacture of a threading strip and its spreading out after having been inserted are generally known, so that they need not be further explained here.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention and its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. Apparatus for manufacturing a material sheet comprising:

a dryer section including at least one double-row dryer group having first and second rows of heated dryer cylinders;

deflection rolls associated with the dryer cylinders;

a transport belt associated with each of the first and second rows of dryer cylinders that circulates in a meandering fashion around the dryer cylinders and the associated deflection rolls;

the transport belts adapted to press the material sheet against surfaces of the dryer cylinders;

a drive mechanism, comprising at least one motor associated with each of the first and second rows, to rotate the dryer cylinders and associated deflection rolls, and to circulate the transport belts of the dryer section; and the drive mechanism adapted to independently regulate a rotational speed of the first and second rows, wherein the drive mechanism at least temporarily drives the first row of dryer cylinders, which receives the material sheet at the beginning of the double-row dryer group, at a rotational speed greater than a rotational speed of the second row of dryer cylinders, which receives the material sheet from the first row of dryer cylinders.

2. The apparatus in accordance with claim 1, wherein the rotational speed of the first row of dryer cylinders is approximately 0.3% to approximately 1.8% greater than the rotational speed of the second row of dryer cylinders.

3. The apparatus in accordance with claim 2, wherein the rotational speed of the first row of dryer cylinders is approximately 0.6% to approximately 1.4% greater than the rotational speed of the second row of dryer cylinders.

4. The machine in accordance with claim 3, wherein the rotational speed of the first row of dryer cylinders is approximately 1% greater than the rotational speed of the second row of dryer cylinders.

5. An apparatus to manufacture a material sheet comprising:

a dryer section including at least one double-row dryer group having first and second rows of heated dryer cylinders;

deflection rolls associated with the dryer cylinders;

a transport belt associated with each of the first and second rows of dryer cylinders that circulates in a meandering fashion around the dryer cylinders and the associated deflection rolls;

the transport belts adapted to press the material sheet against surfaces of the dryer cylinders;

a drive mechanism comprising at least one motor associated with each of the first and second rows, to rotate the dryer cylinders and associated deflection rolls, and to circulate the transport belts of the dryer section; and the drive mechanism adapted to independently regulate a rotational speed of the first and second rows;

wherein the rotational speed of the first row of dryer cylinders is greater than that of the second row only during the transfer of a threading strip.

6. The apparatus in accordance with claim 1, wherein at least one dryer cylinder of each row is assigned a motor.

7. The apparatus in accordance with claim 1, wherein the material sheet is paper.

8. The apparatus in accordance with claim 7, wherein the material sheet is cardboard.

9. An apparatus for manufacturing a material sheet comprising:

a double-row dryer group with first and second rows of dryer cylinders;

at least one transport belt adapted to guide a material sheet;

each of the first and second rows having dryer cylinders and deflection rolls arranged to guide the at least one transport belt in a meandering path around the dryer cylinders;

the at least one transport belt adapted to press the material sheet against the dryer cylinders;

a drive mechanism driving the dryer cylinders and comprising at least one motor assigned to each row of dryer cylinders; and each at least one motor being independently regulated by the drive mechanism, wherein a rotational speed of at least one cylinder of the first row of dryer cylinders is at least temporarily higher than a rotational speed of at least one cylinder of the second row of dryer cylinders.

10. The apparatus of claim 9, wherein the rotational speed of the at least one cylinder of the first row of dryer cylinders is between approximately 0.3% and 1.8% higher than the rotational speed of the at least one cylinder of the second row of dryer cylinders.

11. The apparatus of claim 10, wherein the rotational speed of the at least one cylinder of the first row of dryer cylinders is between approximately 0.6% and 1.4% higher than the rotational speed of the at least one cylinder of the second row of dryer cylinders.

12. The apparatus of claim 11, wherein the rotational speed of the at least one cylinder of the first row of dryer cylinders is approximately 1% higher than the rotational speed of the at least one cylinder of the second row of dryer cylinders.

13. An apparatus for manufacturing a material sheet comprising:

a double-row dryer group with first and second rows of dryer cylinders;

at least one transport belt adapted to guide a material sheet;

each of the first and second rows having dryer cylinders and deflection rolls arranged to guide the at least one transport belt in a meandering path around the dryer cylinders;

the at least one transport belt adapted to press the material sheet against the dryer cylinders;

a drive mechanism driving the dryer cylinders and comprising at least one motor assigned to each row of dryer cylinders; and each at least one motor being independently regulated by the drive mechanism;

wherein the rotational speed of the at least one cylinder of the first row of dryer cylinders is higher than the rotational speed of the at least one cylinder of the second row of dryer cylinders only during a transfer of a threading strip.

14. The apparatus of claim 9, wherein at least one cylinder of each row dryer cylinders is directly driven by a motor.

* * * * *